US011234531B2

(12) United States Patent
Mabon

(10) Patent No.: US 11,234,531 B2
(45) Date of Patent: Feb. 1, 2022

(54) INTEGRATED MOBILE SLEEPING UNIT AND CHAIR SHELL

(71) Applicant: L&P PROPERTY MANAGEMENT COMPANY, South Gate, CA (US)

(72) Inventor: Lewis Alan Mabon, Trinity, NC (US)

(73) Assignee: L&P PROPERTY MANAGEMENT COMPANY, South Gate, CA (US)

( * ) Notice: Subject to any disclaimer, the term of this patent is extended or adjusted under 35 U.S.C. 154(b) by 117 days.

(21) Appl. No.: 16/580,345

(22) Filed: Sep. 24, 2019

(65) Prior Publication Data

US 2021/0085087 A1 Mar. 25, 2021

(51) Int. Cl.

| | |
|---|---|
| ***A47C 17/22*** | (2006.01) |
| ***A47C 17/13*** | (2006.01) |
| ***A47C 17/207*** | (2006.01) |
| ***A47C 17/00*** | (2006.01) |
| ***A47C 17/20*** | (2006.01) |
| ***A47C 17/14*** | (2006.01) |

(52) U.S. Cl.

CPC ..... *A47C 17/225* (2013.01); *A47C 17/00* (2013.01); *A47C 17/138* (2013.01); *A47C 17/14* (2013.01); *A47C 17/20* (2013.01); *A47C 17/207* (2013.01); *A47C 17/22* (2013.01)

(58) Field of Classification Search

CPC ..... A47C 17/22; A47C 17/23; A47C 17/225; A47C 17/138; A47C 17/37; A47C 17/00; A47C 17/2076; A47C 17/207; A47C 17/20; A47C 17/14; A47C 17/08; A47C 17/18; A47C 17/12

See application file for complete search history.

(56) References Cited

U.S. PATENT DOCUMENTS

| | | | | |
|---|---|---|---|---|
| 2,911,655 | A * | 11/1959 | Pokorny, Jr. | A47C 17/213 5/59.1 |
| 3,086,224 | A * | 4/1963 | Layton | A47C 17/14 5/52 |
| 4,074,371 | A | 2/1978 | Lindbloom | |
| 4,086,671 | A | 5/1978 | Lane | |
| 4,343,054 | A | 8/1982 | Kane | |
| 4,366,585 | A | 1/1983 | Ponti et al. | |
| 4,481,684 | A | 11/1984 | Hauck | |
| 4,803,742 | A | 2/1989 | Rasnick et al. | |

(Continued)

*Primary Examiner* — David R Hare
*Assistant Examiner* — Madison Emanski
(74) *Attorney, Agent, or Firm* — Shook Hardy & Bacon, LLP

(57) ABSTRACT

An integrated chair for selectively providing seating support and sleeping support is provided. The integrated chair comprises a mobile sleeping unit and a chair shell. The chair shell comprises: a pair of spaced, opposed, side walls, each side wall having at least a bottom edge, an inner surface and an outer surface; a back wall extending between the pair of side walls; and a pair of truncated arms, one of each of the pair of arms corresponding with a respective one of the pair of side walls, each extending inwardly from the inner surface of a corresponding side wall and having a lower edge that is distal and above the bottom edge of the corresponding side wall; wherein the inner surfaces of the side walls and the lower edge of the arms of the chair shell define a storage compartment sized to accommodate the mobile sleeping unit when the mobile sleeping unit is in the closed position.

12 Claims, 4 Drawing Sheets

(56) References Cited

U.S. PATENT DOCUMENTS

| | | | |
|---|---|---|---|
| 5,893,182 | A | 4/1999 | Sutherland et al. |
| 8,881,325 | B2 | 11/2014 | Cabrera et al. |
| 9,055,822 | B2 | 6/2015 | Baldassarra |
| 9,119,475 | B1 | 9/2015 | Leal et al. |
| 9,241,576 | B2 | 1/2016 | Rodriguez |
| 9,259,086 | B2 | 2/2016 | Wong |
| 9,351,583 | B2 | 5/2016 | Baldassarra |
| 9,420,889 | B2 | 8/2016 | Murphy |
| 9,420,894 | B2 | 8/2016 | Thurow |
| 9,468,303 | B2 | 10/2016 | Garland |
| 9,609,955 | B1 | 4/2017 | Rogers |
| 9,642,468 | B2 | 5/2017 | Murphy et al. |
| 9,980,572 | B2 | 5/2018 | Thurow |

* cited by examiner

INTEGRATED MOBILE SLEEPING UNIT AND CHAIR SHELL

CROSS-REFERENCE TO RELATED APPLICATIONS

None.

STATEMENT REGARDING FEDERALLY SPONSORED RESEARCH OR DEVELOPMENT

None.

BACKGROUND OF THE INVENTION

The present invention relates broadly to a space saving sleepover chair. Furniture providers have recognized the need for temporary sleeping solutions, such as air-mattresses or sofa-sleepers. Sofa-sleepers provide and support a thin mattress that deploys above the floor for sleeping, and that stores under the cushions of a sofa when it is used for sitting. These sofa-sleeper solutions tend to be big (as wide as a sofa) and heavy, due to the amount of metal required in the linkage mechanism that controls the unfolding of the mattress support structure.

There is also a need for smaller sleepover solutions, providing a sleeping surface for only one person, with a width closer to that of a twin mattress. If a chair is provided with a mechanism similar to that of the sofa-sleepers described above, the resulting chair is wider than is often desired. The width of these solutions is the sum of the width of each chair arm, plus at least the width of the mattress (and mechanism), because the mechanism and mattress are located between the arms. Moreover, if the chair is provided with a mechanism similar to that of sofa-sleepers, the resulting chair is often heavier than desired, using a mechanism that is expensive and has heavier duty metal components than is necessary to support a single person. Another deficiency with such a solution is the inflexibility of the provided furniture piece. In these solutions, the mattress and supporting mechanism are coupled to the remainder of the chair, such that the mattress is only deployed by the mechanism in an orientation that extends straight out from the chair. This obviously requires the chair to be placed in the room in a location that allows enough space in front of the chair for the mattress to be so deployed. Additionally, in these prior solutions, the bedding (such as sheets and blankets) is stored remotely from the bed, along with sleeping pillows.

It would be advantageous to provide a chair, with a deployable sleep support surface that addresses the above disadvantages.

SUMMARY

Aspects seek to provide a novel integrated chair for selectively providing seating support and sleeping support. The integrated chair comprises a mobile sleeping unit and a chair shell. The chair shell comprises: a pair of spaced, opposed, side walls, each side wall having at least a bottom edge, an inner surface and an outer surface; a back wall extending between the pair of side walls; and a pair of truncated arms, one of each of the pair of arms corresponding with a respective one of the pair of side walls, each extending inwardly from the inner surface of a corresponding side wall and having a lower edge that is distal and above the bottom edge of the corresponding side wall; wherein the inner surfaces of the side walls and the lower edge of the arms of the chair shell define a storage compartment sized to accommodate the mobile sleeping unit when the mobile sleeping unit is in the closed position.

BRIEF DESCRIPTION OF THE SEVERAL VIEWS OF THE DRAWINGS

In the accompanying drawings which form a part of the specification and which are to be read in conjunction therewith, and in which like reference numerals are used to indicate like parts in the various views.

DETAILED DESCRIPTION OF THE INVENTION

Figure 1:
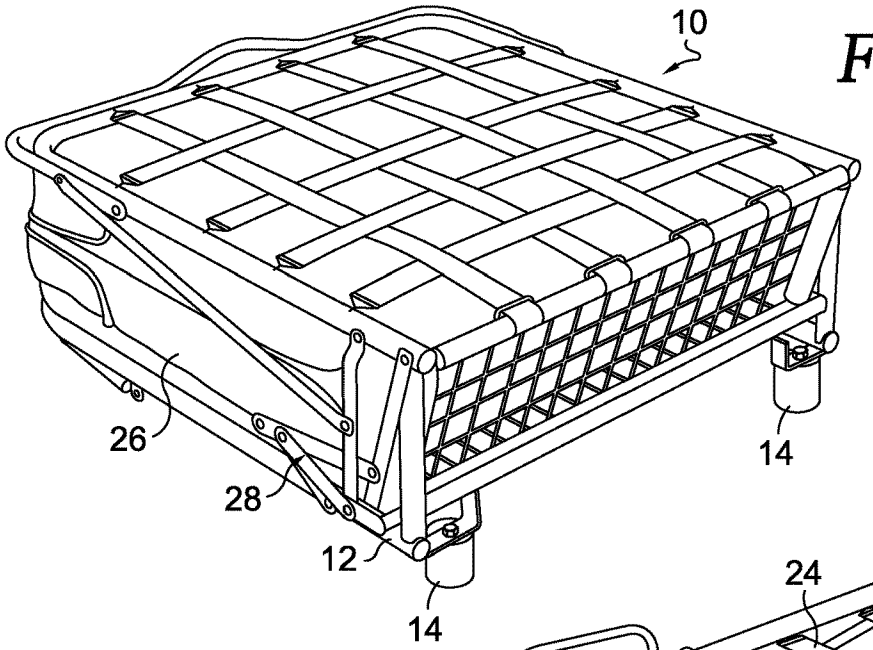
FIG. 1 is a perspective view of an exemplary existing convertible sleeping unit with a mattress in a folded condition.
Figure 2:
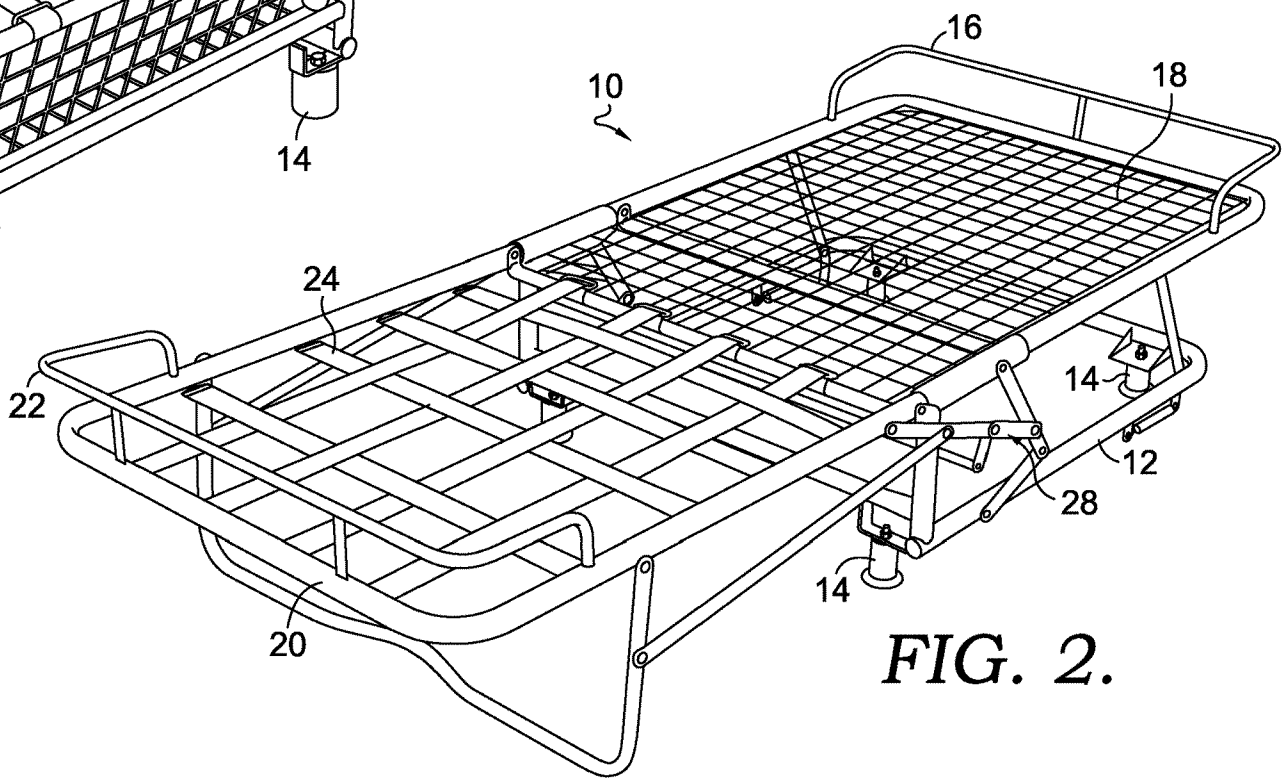
FIG. 2 is a perspective view of the convertible sleeping unit of FIG. 1, but shown in the expanded condition, without the mattress.

FIG. 1 illustrates one aspect of an existing convertible sleeping unit 10. As shown sleeping unit 10 includes a base support 12, typically made from a lightweight, rigid material, such as metal or aluminum. Base support 12 includes a number of legs or casters 14 that support the remainder of the sleeping unit 10 above the underlying support surface, such as the floor. The base support 12, in some aspects, also includes a mattress retainer bar 16. A spring grid 18, in some aspects, spans the open area on the upper part of base support 12. The spring grid 18 can be made from a number of springs, elastomeric fabric material or other spring support materials that are known. An upper support 20 is moveably coupled to base support 12, such as by hinges or pivotal couplings. The upper support 20, in some aspects, also has a mattress retainer bar 22. A spring grid 24 spans the open area formed by the peripheral frame of the upper support 20. The spring grid 24 can be the same as spring grid 18, or could be formed of different spring materials. For example, the spring grid 18 may be formed from springs, while the spring grid 24 may be formed from elastomeric fabric materials. The sleeping unit 10 also includes a mattress 26 that is supported on spring grid 18 and spring grid 24 when the sleeping unit 10 is unfolded or deployed into a configuration for sleep. In some aspects, sleeping unit 10 supports a mattress 26 that is about thirty one inches wide. Mattresses having such a width are sometimes referred to as "RV-twin" mattresses. The mattress retainer bar 16 and mattress retainer bar 22 contain mattress 26 with respect to base support 12 and upper support 20. In use, the sleeping unit 10 can be folded to a closed condition, as shown in FIG. 1, or unfolded to a sleeping position, as shown in FIG. 2 (with the mattress in place). The sleeping unit 10 includes a linkage 28 that moves spring grid 18 upwardly as the upper support 20 is unfolded from the closed position to the open position, to align mattress 26 in the open, horizontal position.

Figure 3:
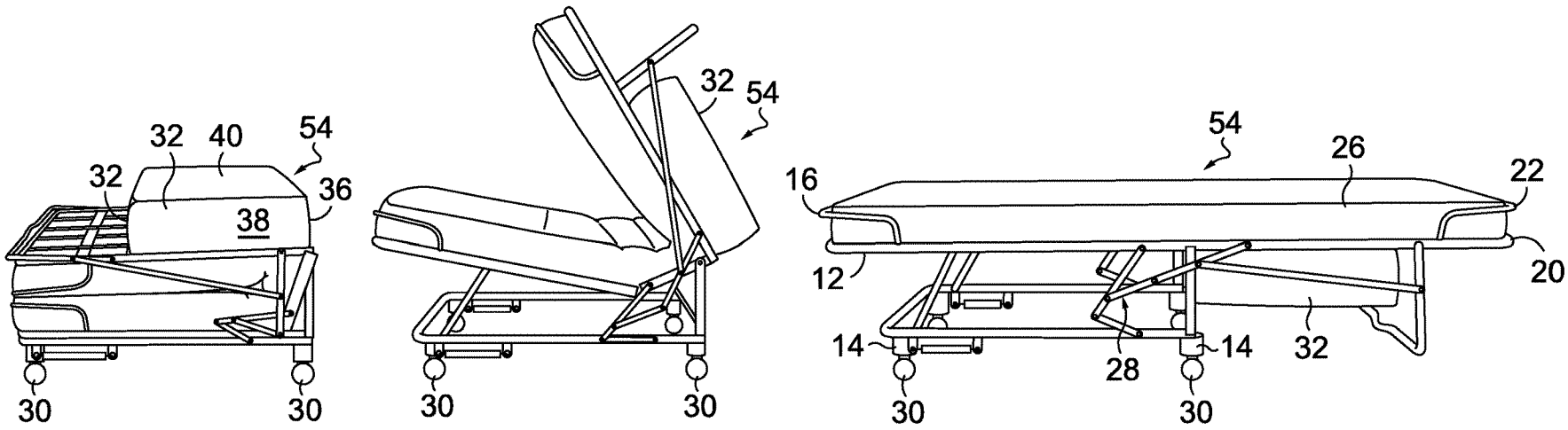
FIG. 3 is a sequence of views of a mobile sleeping unit in the closed, partially open and fully-opened positions.
Figure 5:
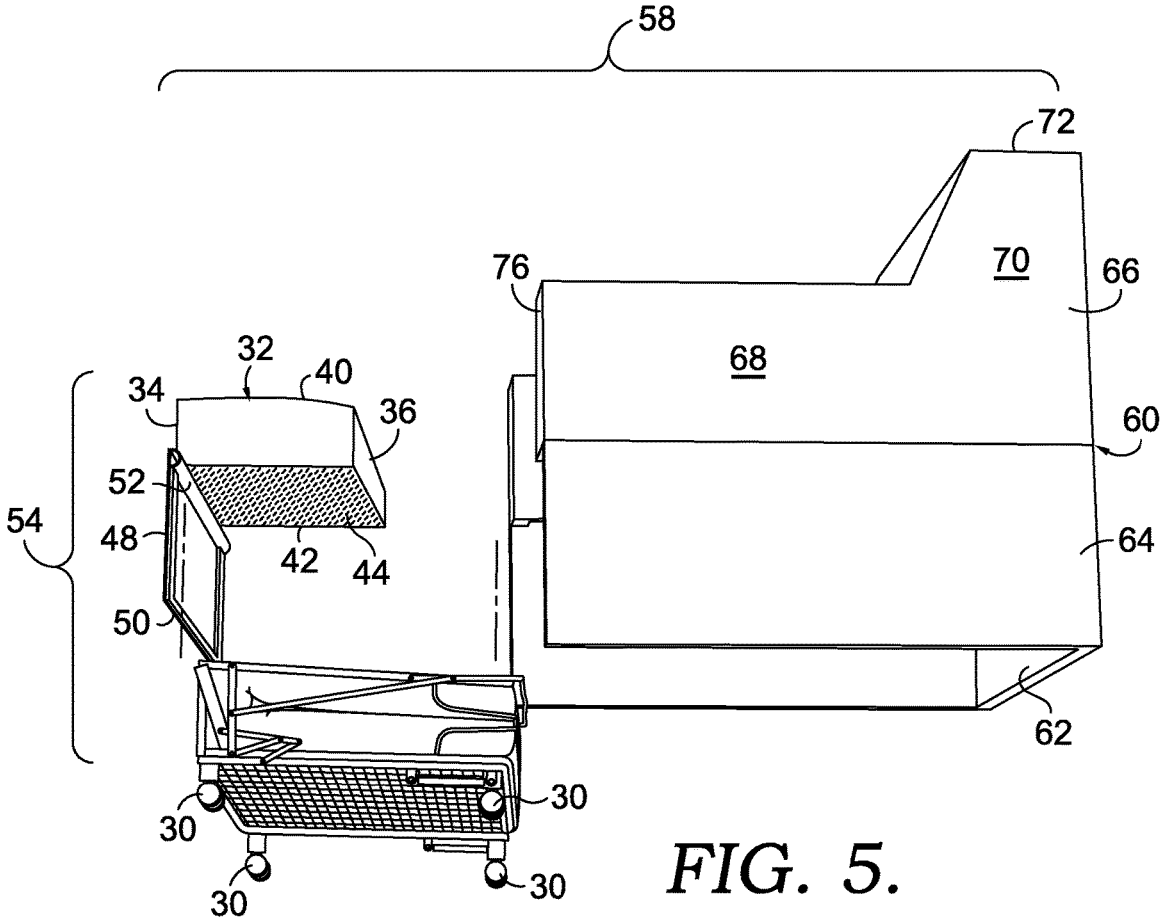
FIG. 5 is a view of FIG. 4 from a different angle.

To make the sleeping unit 10 more practical, useful and easier to store, modifications can be made to sleeping unit 10, and other components can be provided. As best seen in FIG. 3, casters 30 can be exchanged for legs 14 and can be coupled via a nut and bolt combination or through other attaching mechanisms. A seat cushion 32 may be coupled to the side of spring grid 24 facing up when the sleeping unit 10 is in a folded condition. The seat cushion 32 includes a front 34, a back 36, sides 38, a top 40 and a bottom 42. In some aspects, the bottom 42 of seat cushion 32 has one side of a hook and loop fastening material 44 coupled thereto. A corresponding side of the hook and loop fastening material 44 may be coupled to at least parts of the spring grid 24. In this manner, the seat cushion 32 is coupled to the spring grid 24, but can be easily removed if desired. Other attaching mechanisms could also be used, whether providing a removable coupling or a fixed coupling. In some aspects, a front skirt 48 is attached to the front 34 of seat cushion 32, such as by sewing. The front skirt 48 hangs down from seat cushion 32 to hide the remainder of sleeping unit 10 when viewed from the front. Front skirt 48 may, in some aspects, have a width that is greater than the width of sleeping unit 10. Also, in some aspects, the front skirt 48 may be equipped with a lightweight support frame 50 that aids in keeping the shape of front skirt 48 consistent, and aids in keeping the fabric of front skirt 48 taut. As best seen in FIG. 5, a retaining sleeve 52 is coupled to the back side of front skirt 48 adjacent the front 34 and bottom 42 of seat cushion 32. Retaining sleeve 52 can, in some aspects, be made of a cloth material that is flexible and can be attached to front skirt 48 such as be sewing or adhesives. The sleeping unit having the casters 30, seat cushion 32 and front skirt 48 is referenced hereafter as mobile sleeping unit 54.

Figure 4:
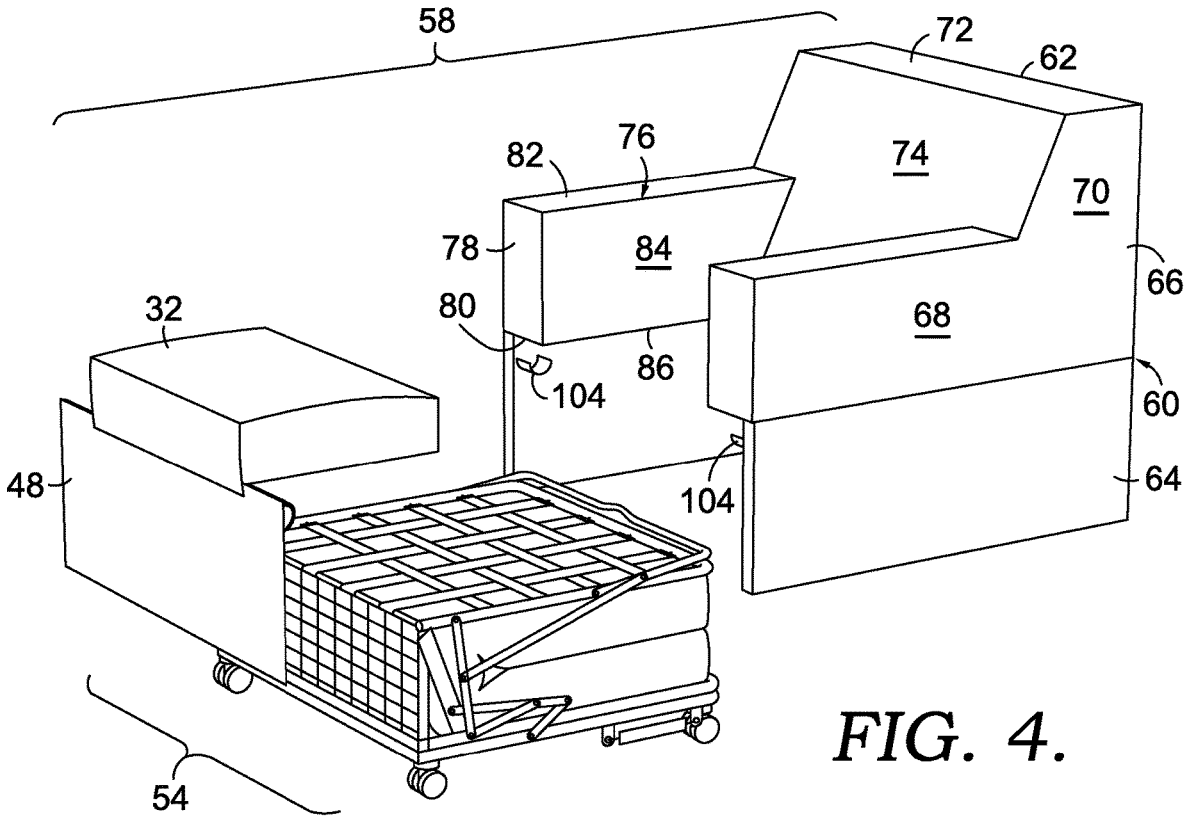
FIG. 4 is an exploded view of an integrated chair, showing the mobile sleeping unit partially exploded and the chair shell.
Figure 7:
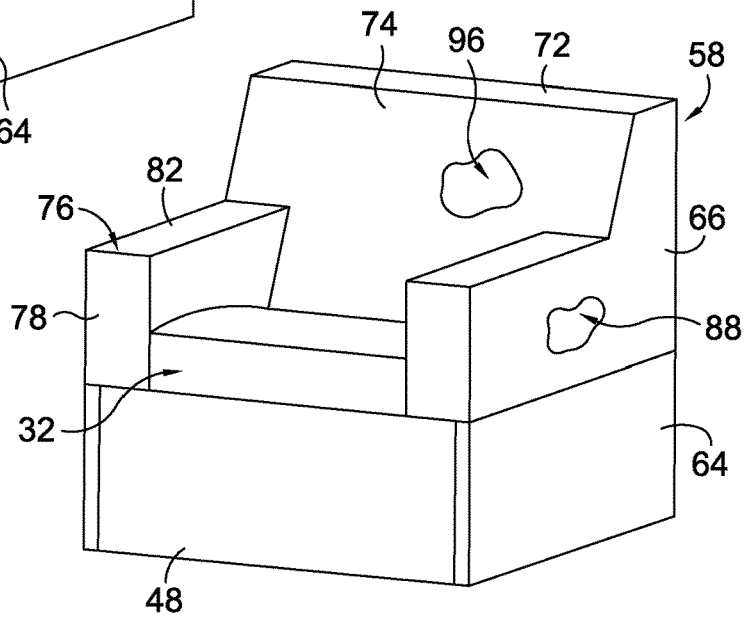
FIG. 7 is a perspective view of the integrated chair with the mobile sleeping unit in the closed position.
Figure 8:
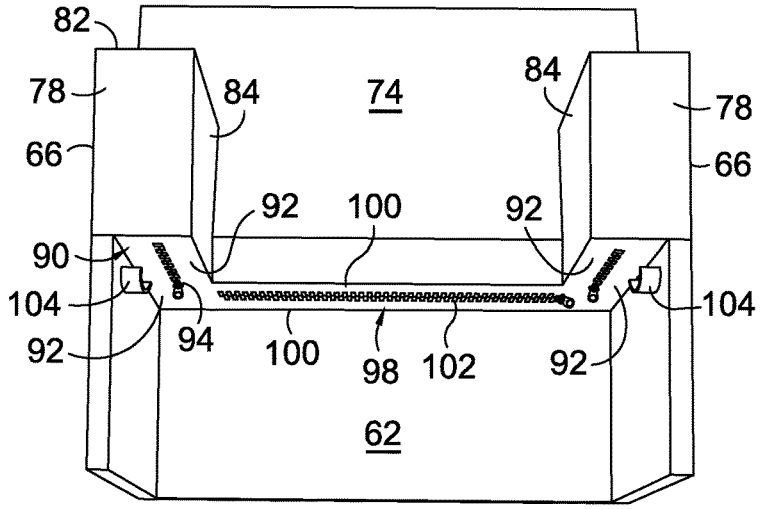
FIG. 8 is a perspective view of the chair shell from the underside.

As best seen in FIGS. 4 and 5, in some aspects, an integrated chair 58 is provided, incorporating the mobile sleeping unit 54 and a chair shell 60. Chair shell 60 includes a back wall 62 that forms that back of the chair shell 60. Chair shell 60 also includes a pair of spaced apart lower side walls 64 that are coupled to back wall 62 and extend orthogonally away from back wall 62. Similarly, chair shell 60 includes a pair of spaced apart upper side walls 66 that are also coupled to back wall 62 and extend orthogonally away from back wall 62. The upper side wall 66 and lower side wall 64 may, in some aspects, be integrally formed or separately formed and coupled together. In some aspects, upper side wall 66 has an arm support section 68 and a back support section 70. The upper edge of arm support section 68 is generally horizontal, and transitions to an angled upper edge of at least a portion of back support section 70. In some aspects, a top wall 72 is coupled to the top of back wall 62, and extends outwardly from back wall 62. A front wall 74 is coupled to top wall 72 and upper side walls 66. In some aspects, front wall 74 is angled, relative to vertical, to provide a slight recline for users as they occupy the integrated chair 58. As best seen in FIGS. 4 and 8, in some aspects, chair shell 60 includes a pair of arms 76. Each arm 76 has a front panel 78 that is coupled to the upper side wall 66 and that extends inwardly from the upper side wall 66. Each front panel 78 also defines a lower edge 80. Each arm 76 also includes a top surface 82 that is coupled to one or more of the front panel 78, upper side wall 66, front wall 74 and/or an inside arm wall 84. Inside arm wall 84 extends from front panel 78 rearwardly to front wall 74, and has a lower edge 86 that is, in some aspects, co-planar with lower edge 80 of front panel 78. As best seen in FIG. 8, upper side wall 66, front panel 78, inside arm wall 84 and top surface 82 form a hollow cavity 88 (shown through the broken area in FIG. 7 behind upper side wall 66). In some aspects, a cavity closure 90 is provided that could include a pair of fabric panels 92, joined by a zipper 94, such that the cavity closure 90 can be selectively opened for access or closed for storage. Similarly, back wall 62, upper side wall 66 and front wall 74 also form a hollow cavity 96 (shown through the broken area in FIG. 7 behind front wall 74). In some aspects, a cavity closure 98 is provided that could include a pair of fabric panels 100, joined by a zipper 102, such that the cavity closure 98 can be selectively opened for access or closed for storage. In other aspects, the zippers 94 are eliminated, with access to the hollow cavities 88 provided through the hollow cavity 96, accessible with zipper 102 in the open condition.

Figure 6:
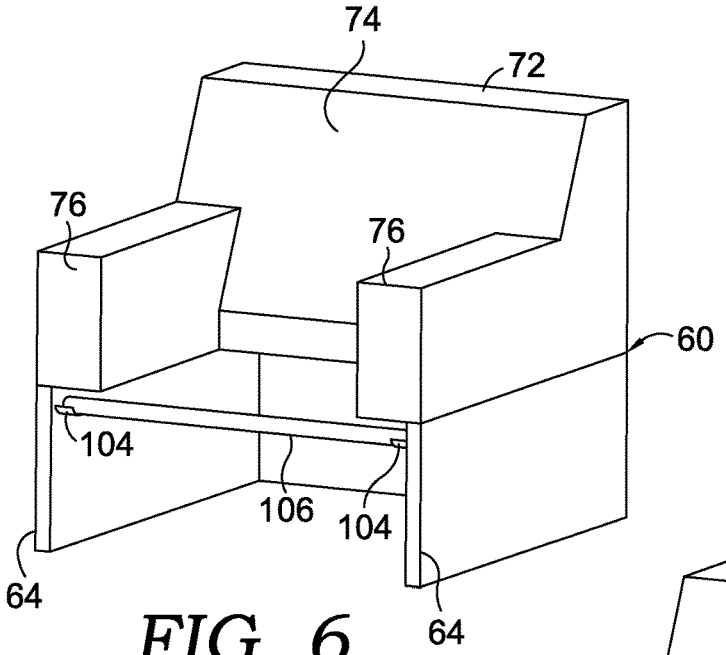
FIG. 6 is a perspective view of the chair shell of FIG. 4, shown with a retention bar in place.

As best seen in FIGS. 4 and 6, in some aspects, a retention bracket 104 is coupled to the inside of each lower side wall 64, such as with screws or other attaching mechanisms. Each bracket 104 may have an open upper end, to selectively receive a retention bar 106. In some aspects, retention bar 106 and brackets 104 may be replaced by a hinged door that extends across the opening in the chair shell 60 between lower side walls 64. In this aspect, the door is hinged on one lower side wall 64, and can be latched or otherwise selectively held in place on the opposite lower side wall 64. When mobile sleeping unit 54 is desired for use, the door is released and swings open to allow the mobile sleeping unit 54 to be removed from under the chair shell 60.

Mobile sleeping unit 54 fits between the lower side walls 64. The lower edge 86 of inside arm wall 84 and the lower edge 80 of front panel 78 define the lower part of arms 76 well above the floor, such that the arms 76 are truncated above the floor. Because arms 76 are truncated, the chair shell 60 is able to house a wider mobile sleeping unit 54 than has been possible with past solutions. In contrast, past solutions used a mechanism secured to full-width arms, so the effective width was equal to the sleeping unit, plus the arms, resulting in a chair that was wider than often desired. With the mobile sleeping unit 54 wheeled into place (using casters 30) with the back 36 of seat cushion 32 adjacent front wall 74 of the chair shell 60, the integrated chair 58 is in a first condition ready for seating. In this first condition, the retention bar 106 may be placed through retaining sleeve 52, with each end of the retention bar 106 being placed in a corresponding retention bracket 104. With retention bar 106 in place, mobile sleeping unit 54 is held in place with respect to chair shell 60.

To use the mobile sleeping unit 54 as a bed, retention bar 106 is removed from containment with retention brackets 104. With retention bar 106 removed, mobile sleeping unit 54 may be move away from chair shell 60, utilizing casters 30. Unlike some previous solutions, mobile seating unit 54 is independent from chair shell 60, and so does not need to stay in any particular orientation relative to chair shell 60. This provides more flexibility in placing the integrated chair 58 in a room, and allows mobile sleeping unit 54 to be deployed in any of a variety of alternate locations. In other words, a user can move the mobile sleeping unit 54 to a desired location before deploying the mobile sleeping unit 54 to the bed configuration. Once at the desired location, mobile sleeping unit 54 is unfolded to expose mattress 26 and place it in the flat, horizontal position (see FIG. 3). Seat cushion 32 can remain in place due to the hook and loop fastener 44, with the seat cushion 32 flipped over as mobile sleeping unit 54 is unfolded. In other aspects, the seat cushion 32 may be removed prior to unfolding mobile sleeping unit 54.

The cavities within chair shell 60 provide storage, which might be used for bedding or pillows when mobile sleeping unit 54 is unfolded. The zippers 94 and 102 allow access to the storage areas provided by the cavities.

While not described above, chair shell 60 may be appropriately finished with fabrics, upholstery, padding or other stylistic and comfort features known to those in the furniture industry. In some aspects, the design of chair shell 60 affords the option of making the components, (such as lower side walls 64, upper side walls 66, back wall 62, top wall 73, front wall 74 and arms 76) ready to assemble and disassemble with appropriate attachment mechanisms, for more convenient transport and shipping. Such a design allows for more compact shipping options, with an easy to assemble furniture piece.

The following clauses represent example aspects of concepts contemplated herein. Any one of the following clauses may be combined in a multiple dependent manner to depend from one or more other clauses. Further, any combination of dependent clauses (clauses that explicitly depend from a previous clause) may be combined while staying within the scope of aspects contemplated herein. The following clauses are illustrative in nature and are not limiting.

Clause 1. An integrated chair, selectively providing seating support and sleeping support, the integrated chair comprising: a mobile sleeping unit, moveable between a closed position with a folded, stored mattress and an open position with an unfolded, exposed mattress; and a chair shell including; a pair of spaced, opposed, side walls, each side wall having at least a bottom edge, an inner surface and an outer surface; a back wall extending between the pair of side walls; and a pair of truncated arms, one of each of the pair of arms corresponding with a respective one of the pair of side walls, each extending inwardly from the inner surface of a corresponding side wall and having a lower edge that is distal and above the bottom edge of the corresponding side wall; wherein the inner surfaces of the side walls and the lower edge of the arms of the chair shell define a storage compartment sized to accommodate the mobile sleeping unit when the mobile sleeping unit is in the closed position.

Clause 2. The integrated chair of clause 1, further comprising: a seat cushion, disposed on top of the mobile seating unit when the mobile seating unit is in the closed position, the seat cushion extending between the truncated arms to provide seating support when the mobile sleeping unit is disposed in the storage compartment of the chair shell.

Clause 3. The integrated chair of any of the preceding clauses, wherein the seating cushion is removably coupled to the mobile sleeping unit.

Clause 4. The integrated chair of any of the preceding clauses, wherein each truncated arm comprises: at least an upper portion of one of the side walls; an inside arm wall spaced apart from the inner surface of the side wall; a top surface extending between a top of the at least a portion of one of the side walls and a top of the inside arm wall; and a front panel extending downwardly from the top surface and between a front of the at least a portion of one of the side walls and a front of the inside arm wall; wherein the at least a portion of one of the side walls, the inside arm wall, the top surface and the front panel form a hollow cavity.

Clause 5. The integrated chair of any of the preceding clauses, wherein the hollow cavity has an opening that is accessible proximate the lower edge of the truncated arm.

Clause 6. The integrated chair of any of the preceding clauses, further comprising a cavity closure extending across the opening of the hollow cavity, wherein the cavity closure may be selectively opened for access to the hollow cavity.

Clause 7. The integrated chair of any of the preceding clauses, wherein the chair shell further comprises a front wall spaced from the back wall and extending between the pair of side walls, the front wall having a lower edge that is co-planar with the lower edge of the truncated arms, the space between the front wall and back wall defining a hollow cavity with an opening proximate the lower edge of the front wall.

Clause 8. The integrated chair of any of the preceding clauses, further comprising: a pair of brackets, one of each of the pair of brackets being coupled to a respective inner surface of a side wall proximate the lower edge of a truncated arm; and a retention bar releasably coupled between the pair of brackets, the retention bar retaining the mobile sleeping unit within the defined storage compartment of the chair shell; wherein the retention bar can be removed to allow the mobile sleeping unit to be removed from the defined storage compartment of the chair shell when desired to move the mobile sleeping unit to the open position with an unfolded, exposed mattress for sleeping support.

Clause 9. The integrated chair of any of the preceding clauses, further comprising: a front skirt coupled to the mobile sleeping unit, the front skirt extending between the side walls when the mobile sleeping unit is disposed in the defined storage compartment.

Clause 10. The integrated chair of any of the preceding clauses, further comprising a retaining sleeve coupled to the top of the front skirt, the retaining sleeve sized to accommodate the retention bar.

Clause 11. A chair shell for providing a storage compartment for a mobile sleeping unit, moveable between a closed position with a folded, stored mattress and an open position with an unfolded, exposed mattress, the chair shell comprising: a pair of spaced, opposed, side walls, each side wall having at least a bottom edge, an inner surface and an outer surface; a back wall extending between the pair of side walls; and a pair of truncated arms, one of each of the pair of arms corresponding with a respective one of the pair of side walls, each extending inwardly from the inner surface of a corresponding side wall and having a lower edge that is distal and above the bottom edge of the corresponding side wall; wherein the inner surfaces of the side walls and the lower edge of the arms of the chair shell define a storage compartment sized to accommodate the mobile sleeping unit when the mobile sleeping unit is in the closed position.

Clause 12. The chair shell of clause 11, wherein each truncated arm comprises: at least an upper portion of one of the side walls; an inside arm wall spaced apart from the inner surface of the side wall; a top surface extending between a top of the at least a portion of one of the side walls and a top of the inside arm wall; and a front panel extending downwardly from the top surface and between a front of the at least a portion of one of the side walls and a front of the inside arm wall; wherein the at least a portion of one of the side walls, the inside arm wall, the top surface and the front panel form a hollow cavity.

Clause 13. The chair shell of any of clauses 11-12, wherein the hollow cavity has an opening that is accessible proximate the lower edge of the truncated arm.

Clause 14. The chair shell of any of clauses 11-13, further comprising a cavity closure extending across the opening of the hollow cavity, wherein the cavity closure may be selectively opened for access to the hollow cavity.

Clause 15. The chair shell of any of clauses 11-14, further comprising a front wall spaced from the back wall and extending between the pair of side walls, the front wall having a lower edge that is co-planar with the lower edge of the truncated arms, the space between the front wall and back wall defining a hollow cavity with an opening proximate the lower edge of the front wall.

Clause 16. The chair shell of any of clauses 11-15, further comprising: a pair of brackets, one of each of the pair of brackets being coupled to a respective inner surface of a side wall proximate the lower edge of a truncated arm; and a retention bar releasably coupled between the pair of brackets, the retention bar retaining the mobile sleeping unit within the defined storage compartment of the chair shell; wherein the retention bar can be removed to allow the mobile sleeping unit to be removed from the defined storage compartment of the chair shell when desired to move the mobile sleeping unit to the open position with an unfolded, exposed mattress for sleeping support.

The present invention has been described in relation to particular embodiments, which are intended in all respects to be illustrative rather than restrictive. Alternative aspects will become apparent to those skilled in the art to which the present invention pertains without departing from its scope.

It will be seen from the foregoing that this invention is one well adapted to attain the ends and objects set forth above, and to attain other advantages, which are obvious and inherent in the device. It will be understood that certain features and subcombinations are of utility and may be employed without reference to other features and subcombinations. This is contemplated by and within the scope of the claims. It will be appreciated by persons skilled in the art that the present invention is not limited to what has been particularly shown and described hereinabove. Rather, all matter herein set forth or shown in the accompanying drawings is to be interpreted as illustrative and not limiting.

What is claimed is:

1. An integrated chair, selectively providing seating support and sleeping support, the integrated chair comprising: a mobile sleeping unit, moveable between a closed position with a folded, stored mattress and an open position with an unfolded, exposed mattress; and a chair shell, decoupled from the mobile sleeping unit, including; a pair of spaced, opposed, side walls, each side wall having at least a bottom edge, an inner surface and an outer surface; a back wall extending between the pair of side walls; and a pair of truncated arms, one of each of the pair of arms corresponding with a respective one of the pair of side walls, each extending inwardly from the inner surface of a corresponding side wall and having a lower edge that is distal and above the bottom edge of the corresponding side wall; wherein the inner surfaces of the side walls and the lower edge of the arms of the chair shell define a storage compartment sized to accommodate the mobile sleeping unit when the mobile sleeping unit is in the closed position, and wherein the inner surfaces of the side walls and the back wall define an opening proximate the front of the chair allowing the mobile sleeping unit to be separated from the defined storage compartment of the chair, and wherein each truncated arm comprises: at least an upper portion of one of the side walls; an inside arm wall spaced apart from the inner surface of the side wall; a top surface extending between a top of the at least a portion of one of the side walls and a top of the inside arm wall; and a front panel extending downwardly from the top surface and between a front of the at least a portion of one of the side walls and a front of the inside arm wall; wherein the at least a portion of one of the side walls, the inside arm wall, the top surface and the front panel form a hollow cavity, wherein the hollow cavity has an opening that is accessible proximate the lower edge of the truncated arm.

2. The integrated chair of claim 1, further comprising:

a seat cushion, disposed on top of the mobile seating unit when the mobile seating unit is in the closed position, the seat cushion extending between the truncated arms to provide seating support when the mobile sleeping unit is disposed in the storage compartment of the chair shell.

3. The integrated chair of claim 2, wherein the seat cushion is removably coupled to the mobile sleeping unit.

4. The integrated chair of claim 3, further comprising a cavity closure extending across the opening of the hollow cavity, wherein the cavity closure may be selectively opened for access to the hollow cavity.

5. The integrated chair of claim 4, wherein the chair shell further comprises a front wall spaced from the back wall and extending between the pair of side walls, the front wall having a lower edge that is co-planar with the lower edge of the truncated arms, the space between the front wall and back wall defining a hollow cavity with an opening proximate the lower edge of the front wall.

6. The integrated chair of claim 5, further comprising:

a pair of brackets, one of each of the pair of brackets being coupled to a respective inner surface of a side wall proximate the lower edge of a truncated arm; and a retention bar releasably coupled between the pair of brackets, the retention bar retaining the mobile sleeping unit within the defined storage compartment of the chair shell;

wherein the retention bar can be removed to allow the mobile sleeping unit to be removed from the defined storage compartment of the chair shell when desired to move the mobile sleeping unit to the open position with an unfolded, exposed mattress for sleeping support.

7. The integrated chair of claim 6, further comprising:

a front skirt coupled to the mobile sleeping unit, the front skirt extending between the side walls when the mobile sleeping unit is disposed in the defined storage compartment.

8. The integrated chair of claim 7, further comprising a retaining sleeve coupled to the top of the front skirt, the retaining sleeve sized to accommodate the retention bar.

9. A chair shell for providing a storage compartment for a mobile sleeping unit, moveable between a closed position with a folded, stored mattress and an open position with an unfolded, exposed mattress, the chair shell comprising: a pair of spaced, opposed, side walls, each side wall having at least a bottom edge, an inner surface and an outer surface; a back wall extending between the pair of side walls; and a pair of truncated arms, one of each of the pair of arms corresponding with a respective one of the pair of side walls, each extending inwardly from the inner surface of a corresponding side wall and having a lower edge that is distal and above the bottom edge of the corresponding side wall, at least an upper portion of one of the side walls; wherein each truncated arm includes an inside arm wall spaced apart from the inner surface of the side wall; a top surface extending between a top of the at least a portion of one of the side walls and a top of the inside arm wall; and a front panel extending downwardly from the top surface and between a front of the at least a portion of one of the side walls and a front of the inside arm wall; wherein the at least a portion of one of the side walls, the inside arm wall, the top surface and the front panel form a hollow cavity; wherein the inner surfaces of the side walls and the lower edge of the arms of the chair shell define a storage compartment sized to accommodate the mobile sleeping unit when the mobile sleeping unit is in the closed position, wherein the hollow cavity has an opening that is accessible proximate the lower edge of the truncated arm.

10. The chair shell of claim 9, further comprising a cavity closure extending across the opening of the hollow cavity, wherein the cavity closure may be selectively opened for access to the hollow cavity.

11. The chair shell of claim 10, further comprising a front wall spaced from the back wall and extending between the pair of side walls, the front wall having a lower edge that is co-planar with the lower edge of the truncated arms, the space between the front wall and back wall defining a hollow cavity with an opening proximate the lower edge of the front wall.

12. The chair shell of claim 11, further comprising:

a pair of brackets, one of each of the pair of brackets being coupled to a respective inner surface of a side wall proximate the lower edge of a truncated arm; and a retention bar releasably coupled between the pair of brackets, the retention bar retaining the mobile sleeping unit within the defined storage compartment of the chair shell;

wherein the retention bar can be removed to allow the mobile sleeping unit to be removed from the defined storage compartment of the chair shell when desired to move the mobile sleeping unit to the open position with an unfolded, exposed mattress for sleeping support.

* * * * *